US011790748B2

(12) United States Patent
Kim et al.

(10) Patent No.: US 11,790,748 B2
(45) Date of Patent: Oct. 17, 2023

(54) DEVICE AND METHOD FOR ASSESSING RISK OF LONELY DEATH USING DOOR OPEN SENSOR, AND LED SYSTEM FOR ASSESSING RISK OF LONELY DEATH

(71) Applicant: INNOLEADINGSOLUTION CO., LTD., Busan (KR)

(72) Inventors: Jung Yeon Kim, Busan (KR); Young Lok Kim, Usan (KR)

(73) Assignee: INNOLEADINGSOLUTION CO., LTD., Busan (KR)

( * ) Notice: Subject to any disclaimer, the term of this patent is extended or adjusted under 35 U.S.C. 154(b) by 0 days.

(21) Appl. No.: 17/777,948

(22) PCT Filed: Oct. 30, 2020

(86) PCT No.: PCT/KR2020/014999
§ 371 (c)(1),
(2) Date: May 18, 2022

(87) PCT Pub. No.: WO2021/101116
PCT Pub. Date: May 27, 2021

(65) Prior Publication Data

US 2022/0415154 A1 Dec. 29, 2022

(30) Foreign Application Priority Data

Nov. 19, 2019 (KR) ..... 10-2019-0149021

(51) Int. Cl.
*G08B 21/04* (2006.01)

(52) U.S. Cl.
CPC ..... *G08B 21/0415* (2013.01); *G08B 21/0438* (2013.01)

(58) Field of Classification Search
CPC ..... G08B 21/0415; G08B 21/0438; G08B 21/0423; A61B 5/165
See application file for complete search history.

(56) References Cited

U.S. PATENT DOCUMENTS 11,120,226 B1 * 9/2021 Nudd ..... G16H 80/00
11,625,999 B2 * 4/2023 Balaji ..... A61B 5/7264 340/573.1

(Continued)

FOREIGN PATENT DOCUMENTS

JP 2015-207077 A 11/2015
KR 10-2016-0041203 A 4/2016

(Continued)

*Primary Examiner* — Albert K Wong
(74) *Attorney, Agent, or Firm* — Maschoff Brennan

(57) ABSTRACT

The present invention relates to: a device and method for assessing the risk of lonely death using a door open sensor; and a LED system for assessing the risk of lonely death. More specifically, the device for assessing the risk of lonely death using a door open sensor, according to one embodiment of the present invention, comprises: a door open recognition unit which recognizes that a door has been opened; an outside activity time calculation unit which, when the door is recognized to have been opened, and activity of a human body is not detected from the time point when the door is recognized to have been opened to a predetermined time, determines an outside activity state and calculates an outside activity duration which is the time during which the outside activity state is maintained; an inside activity time calculation unit which, when activity of the human body is detected at a first time point, and activity of the human body is detected again at a second time point which includes an idle detection period after the first time point, determines an inside activity state and calculates an inside activity duration which is the time during which the inside activity state is maintained; and a risk assessment unit which assesses the risk of lonely death by generating a probability distribution model on the basis of the outside activity durations and inside activity durations calculated during a first period, and applying, to the probability distri- (Continued)

bution model, the outside activity duration and inside activity duration calculated after the first period.

9 Claims, 4 Drawing Sheets

(56) References Cited

U.S. PATENT DOCUMENTS

| | | | | |
|---|---|---|---|---|
| 11,631,401 | B1 * | 4/2023 | Nudd | G10L 15/16 704/9 |
| 2003/0114736 | A1 * | 6/2003 | Reed | G06Q 10/10 600/300 |
| 2009/0256710 | A1 * | 10/2009 | Duckert | G08B 21/0484 340/573.1 |
| 2014/0377727 | A1 * | 12/2014 | Yom-Tov | G16H 50/20 434/236 |
| 2016/0287166 | A1 * | 10/2016 | Tran | A61B 5/74 |
| 2018/0075763 | A1 * | 3/2018 | Wainfan | G16H 20/70 |
| 2021/0312784 | A1 * | 10/2021 | Valenti | A61B 5/1112 |

FOREIGN PATENT DOCUMENTS

| | | | |
|---|---|---|---|
| KR | 10-1911039 | B1 | 10/2018 |
| KR | 10-2019-0051353 | A | 5/2019 |
| KR | 10-2022256 | B1 | 9/2019 |
| KR | 10-2153238 | B1 | 9/2020 |

* cited by examiner

[FIG.1]
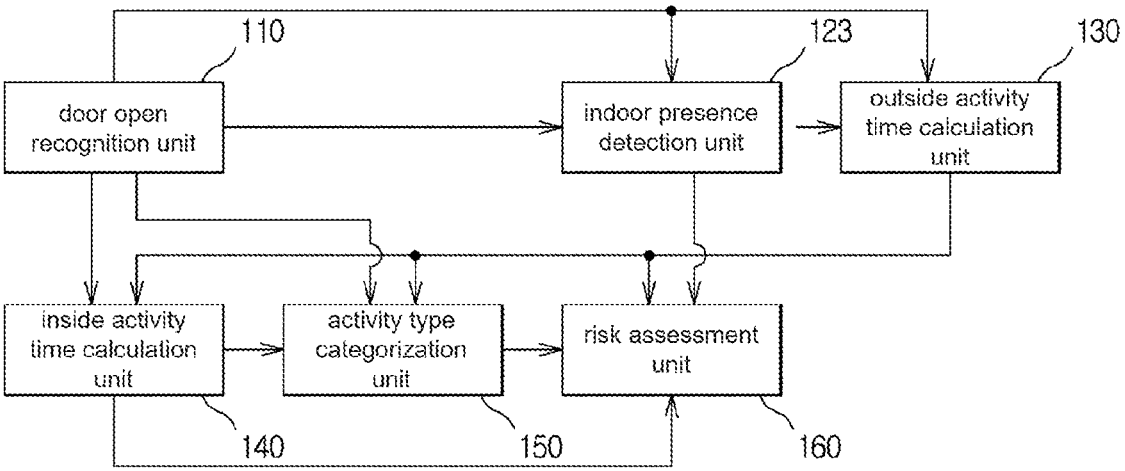
[FIG.2]
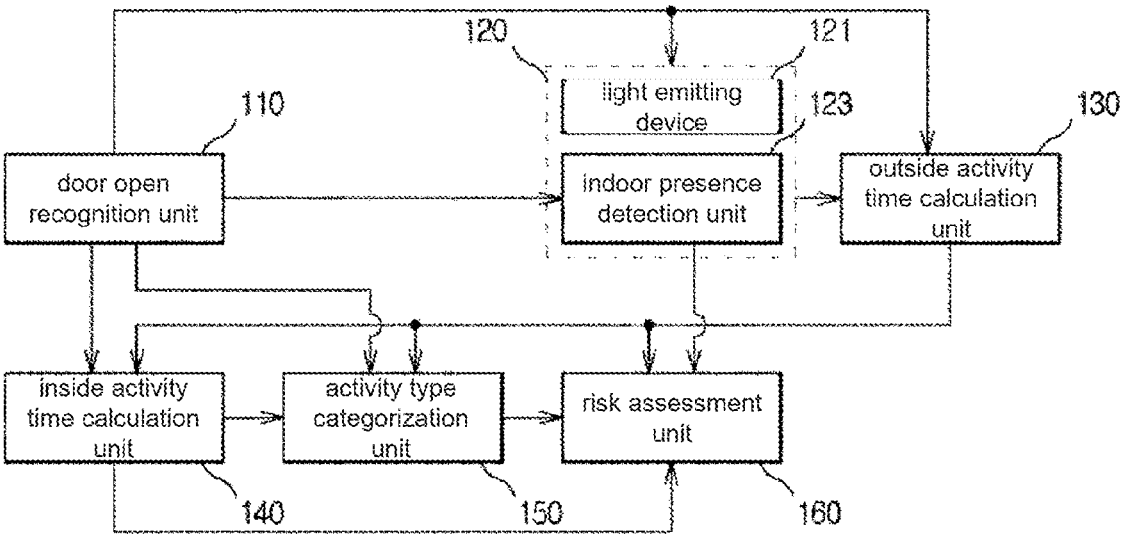

[FIG.3]
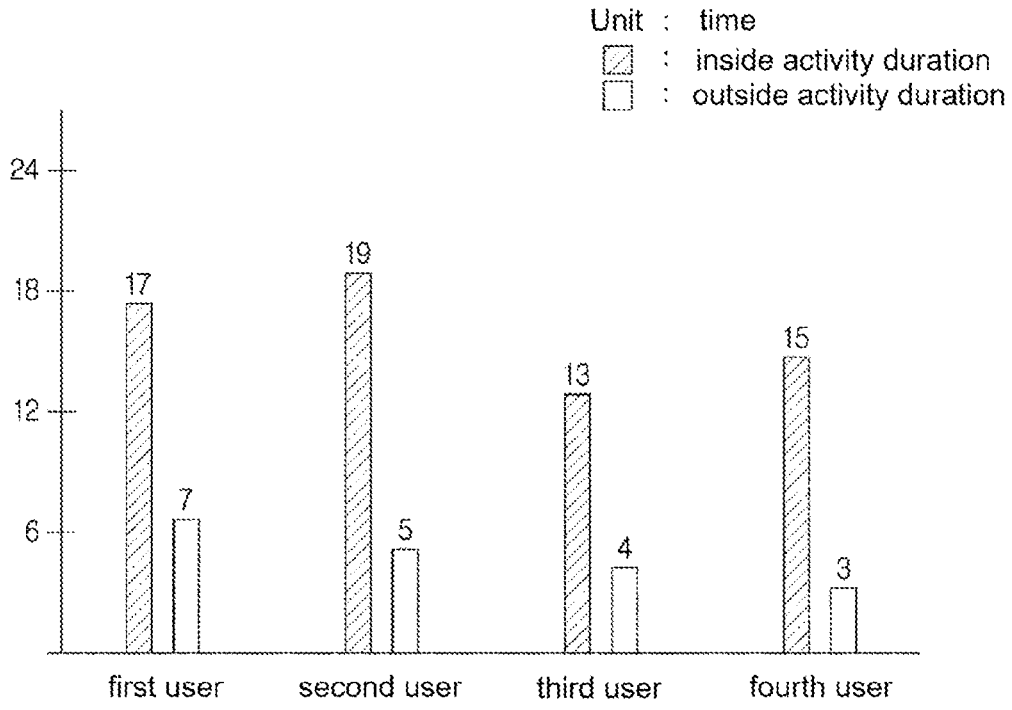

[FIG.4]
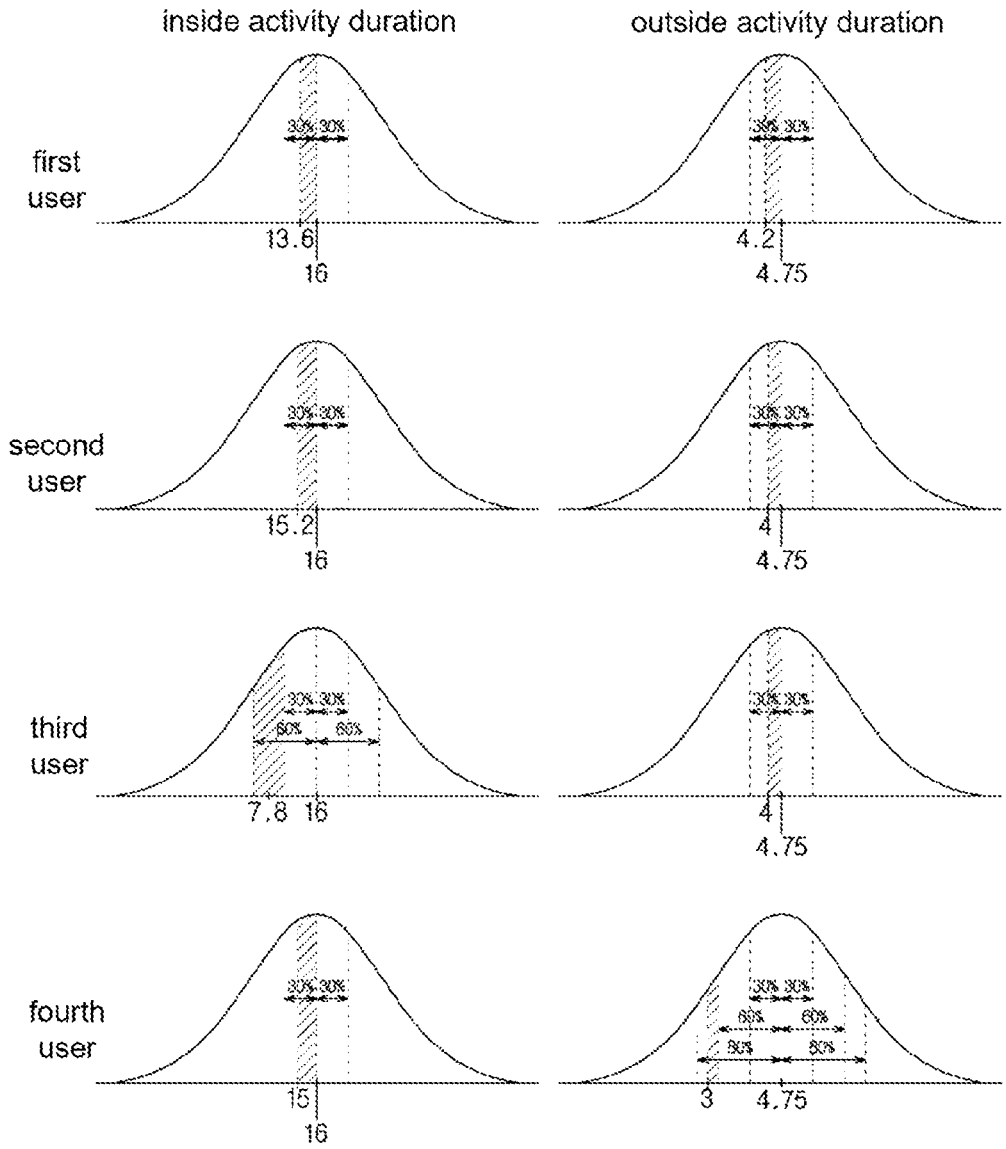

[FIG.5]
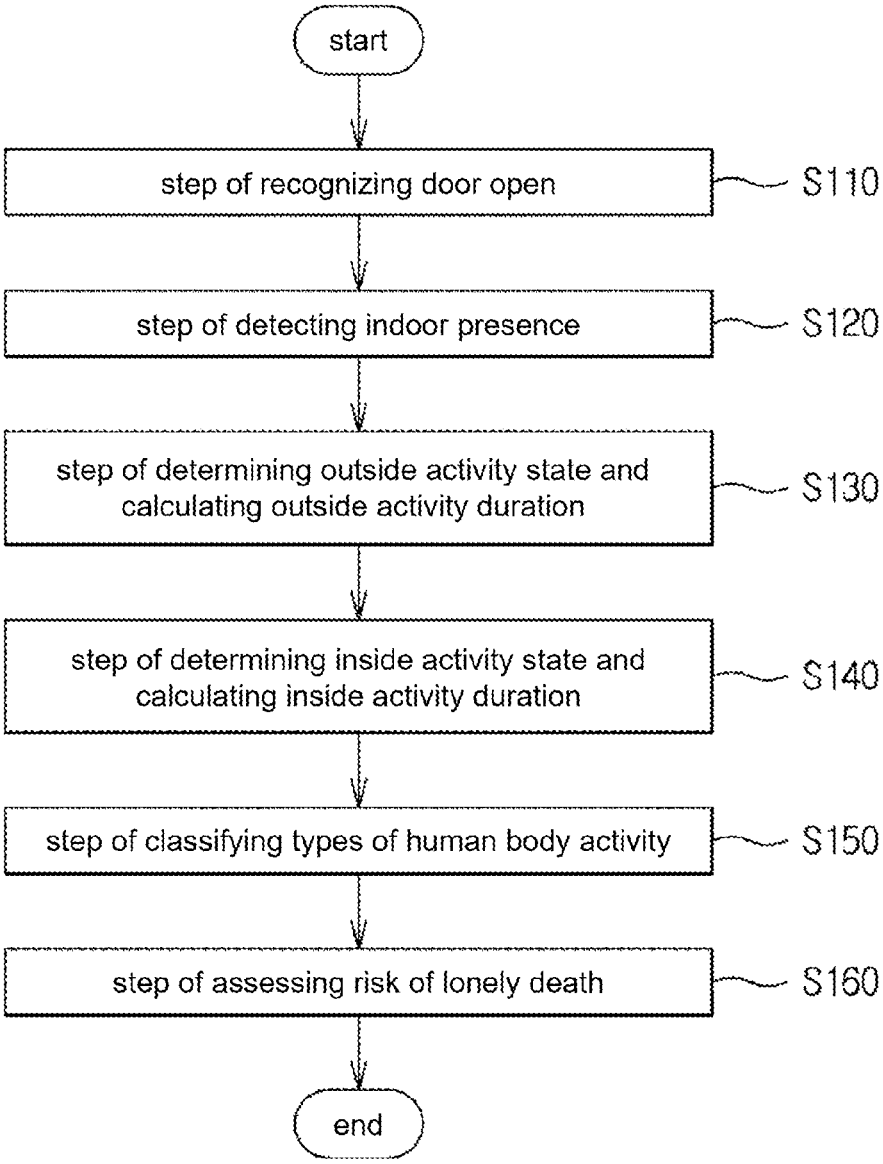

DEVICE AND METHOD FOR ASSESSING RISK OF LONELY DEATH USING DOOR OPEN SENSOR, AND LED SYSTEM FOR ASSESSING RISK OF LONELY DEATH

TECHNICAL FIELD

The present invention relates to a device and a method for assessing the risk of lonely death using a door open sensor and an LED system for assessing the risk of lonely death, and more specifically to a device and a method for assessing the risk of lonely death using a door open sensor, which assess the risk of lonely death by detecting door open using a sensor, and an LED system for assessing the risk of lonely death.

BACKGROUND ART

Recently, the number of elderly households where only the elderly live and single-person households is increasing due to the tendency of nuclear family, low fertility, and aging society. In particular, in the case of the elderly who live alone without anyone to take care of them, the number of lonely deaths is increasing.

As Korea tends to move into the aging society fastest in the world, more systematic and effective advanced welfare services for the elderly are required. In particular, the lonely death of the elderly living alone or the disabled is emerging as a social issue, so it is necessary to solve the difficulties in management due to the civil complaints handled by local government officials, and the shortage of social workers and visiting nurses and service limitations, and there is a need for a plan to link and develop welfare services for the elderly living alone with services for the socially disadvantaged. An independent lonely death management system is needed to predict lonely death and to deal with the lonely death when the lonely death occurs. To manage lonely death, it is necessary to check the health and activity status of the subject to be observed.

Currently, the government's social workers or private volunteer groups are managing the elderly living alone. However, the reality is that the government social workers or private volunteer groups are insufficient to take care of all the elderly living alone that are increased due to the rapid aging of the population. In addition, some welfare support services cannot deal with the elderly while continuously living with the elderly living alone, so it is not possible to quickly recognize the emergency or personal abnormality of the elderly living alone, so that it is not easy to take action against the lonely death of the elderly living alone.

A plan is needed to technically solve the shortage of manpower, and it is necessary to provide a system that allows social workers, private volunteer groups, or individuals to monitor the situation of the elderly living alone by simply attaching a terminal through simple settings in order to recognize the signs of lonely death for the elderly living alone to prevent the lonely death in advance.

DISCLOSURE

Technical Problem

The present invention has been made to solve the above problems, and an object of the present invention is to provide a device and a method for assessing the risk of lonely death using a door open sensor, and an LED system for assessing the risk of lonely death, which calculates outside activity time and inside activity time by detecting door open through the door open sensor, and classifying an activity type and a risk level based on the outside activity time and inside activity time to assess the risk of lonely death.

The object of the present invention is not limited to the object mentioned above, and other objects will be clearly understood from the description below.

Technical Solution

In order to achieve the above object, a device for assessing a risk of lonely death using a door open sensor according to one aspect of the present invention includes: a door open recognition unit which recognizes a door open; an outside activity time calculation unit which determines as an outside activity state when a human body activity is not detected for a predetermined time from a time point at which the door open is recognized, and calculates an outside activity duration which is a time during which the outside activity state is maintained; an inside activity time calculation unit which determines as an inside activity state when the human body activity is detected at a first time point and the human body activity is detected again at a second time point having an idle detection period after the first time point, and calculates an inside activity duration which is a time during which the inside activity state is maintained; and a risk assessment unit which assesses the risk of lonely death by generating a probability distribution model based on the outside activity duration and inside activity duration calculated in a first period, and applying the outside activity duration and inside activity duration calculated after the first period to the probability distribution model.

A method for assessing a risk of lonely death using a door open sensor according to another aspect of the present invention includes: recognizing a door open; determining as an outside activity state when a human body activity is not detected for a predetermined time from a time point at which the door open is recognized, and calculating an outside activity duration which is a time during which the outside activity state is maintained; determining as an inside activity state when the human body activity is detected at a first time point and the human body activity is detected again at a second time point having an idle detection period after the first time point, and calculating an inside activity duration which is a time during which the inside activity state is maintained; calculating a relative ratio of the inside activity duration and the outside activity duration, and classifying human body activity types based on whether the outside activity duration or the inside activity duration exceeds a preset threshold and based on the relative ratio; and assessing the risk of the lonely death by generating a probability distribution model based on the outside activity duration and inside activity duration calculated in a first period, and applying the outside activity duration and inside activity duration calculated after the first period to the probability distribution model, An LED system for assessing a risk of lonely death according to still another aspect of the present invention includes: an LED module including a light emitting device for allowing an LED on an LED substrate to emit light so that the light is diffused, and an indoor presence detection unit configured to transmit a signal having a predetermined pattern to a predetermined area and receive the transmitted signal, in which the indoor presence detection unit includes a sensor having an output equal to or higher than a preset level to detect indoor presence when a human body activity is detected in the predetermined area; a door open recognition unit which recognizes a door open; an outside activity time calculation unit which determines as an outside activity state when a human body activity is not detected for a predetermined time from a time point at which the door open is recognized, and calculates an outside activity duration which is a time during which the outside activity state is maintained; an inside activity time calculation unit which determines as an inside activity state when the human body activity is detected at a first time point and the human body activity is detected again at a second time point having an idle detection period after the first time point, and calculates an inside activity duration which is a time during which the inside activity state is maintained; a risk assessment unit which assesses the risk of lonely death by generating a probability distribution model based on the outside activity duration and inside activity duration calculated in a first period, and applying the outside activity duration and inside activity duration calculated after the first period to the probability distribution model; and an activity type categorization unit that calculates a relative ratio of the inside activity duration and the outside activity duration, and classifies human body activity types based on whether the outside activity duration or the inside activity duration exceeds a preset threshold and based on the relative ratio,

Advantageous Effects

According to the present invention, it is possible to prevent lonely death in advance by classifying the activity type and risk level of the user.

According to the present invention, there is an effect of efficiently predicting the possibility of occurrence of lonely death by classifying users based on the activity type and observing signs that are inconsistent with the activity type of each user.

The effect according to the present invention is not limited by the contents exemplified above, and more various effects are included in the present specification.

DESCRIPTION OF DRAWINGS

FIG. 1 is a block diagram illustrating a device for assessing the risk of lonely death using a door open sensor according to an embodiment of the present invention.

FIG. 2 is a block diagram illustrating an LED system for assessing the risk of lonely death using a door open sensor according to another embodiment of the present invention.

FIG. 3 is a view for explaining an activity type categorization unit of a device for assessing the risk of lonely death using a door open sensor and an LED system for assessing the risk of lonely death according to embodiments of the present invention.

FIG. 4 is a view for explaining a risk assessment unit of a device for assessing the risk of lonely death using a door open sensor and an LED system for assessing the risk of lonely death according to embodiments of the present invention.

FIG. 5 is a flowchart illustrating a method for assessing the risk of lonely death using a door open sensor according to another embodiment of the present invention.

BEST MODE

Mode for Invention

Advantages and features of the present invention, and a method of achieving them will become apparent with reference to the embodiments described below in detail in conjunction with the accompanying drawings. However, the present invention is not limited to the embodiments disclosed below, but will be implemented in a variety of different forms, and these embodiments are provided to allow the disclosure of the present invention to be complete, and to completely inform those skilled in the art to which the present invention pertains of the scope of the invention and the present invention is only defined by the description of the claims. Meanwhile, the terms used herein are for the purpose of describing the embodiments, and are not intended to limit the present invention. In this specification, the singular form also includes the plural form unless otherwise specified in the phrase. Hereinafter, an embodiment of the present invention will be described in detail with reference to the accompanying drawings.

The redundant contents and configurations described in the device for assessing the risk of lonely death using the door open sensor according to an embodiment of the present invention and the LED system for assessing the risk of lonely death using the door open sensor according to another embodiment of the present invention will be denoted with the same reference numerals and repeated descriptions thereof will be omitted.

Referring to FIG. 1, the device for assessing the risk of lonely death using a door open sensor according to an embodiment of the present invention includes a door open recognition unit 110, an indoor presence detection unit 123, an outside activity time calculation unit 130, an inside activity time calculation unit 140, an activity type categorization unit 150, and a risk assessment unit 160.

Referring to FIG. 2, the LED system for assessing the risk of lonely death using a door open sensor according to another embodiment of the present invention includes a door open recognition unit 110, an LED module 120, an outside activity time calculation unit 130, an inside activity time calculation unit 140, an activity type categorization unit 150, and a risk assessment unit 160.

The door open recognition unit 110 recognizes the door open.

The door open recognition unit 110 may recognize the door open of each door through a sensor attached to an entrance door, a room door, and a toilet door in a house of a user whenever the door is opened.

The LED system for assessing the risk of lonely death using a door open sensor according to another embodiment of the present invention includes an LED module 120, and the LED module includes a light emitting device 121 and an indoor presence detection unit 123.

The LED module 120 detects indoor presence by using an LED lighting lamp equipped with a sensor and a light emitting material.

The LED module 120 is installed in each room in a house of a user, detects the indoor presence, movement, and activity pattern of the user using the LED lighting lamp equipped with a sensor and a light emitting material, and assesses the risk of lonely death to prevent lonely death in advance.

The light emitting device 121 causes the LED on an LED substrate to emit light so that the light is diffused.

The indoor presence detection unit 123 transmits a signal having a predetermined pattern to a predetermined area and receives the transmitted signal, and includes a sensor having an output of a predetermined level or higher when a human body activity is detected in the predetermined area detect to detect whether the user is present in the room.

The indoor presence detection unit 123 may be equipped with an IR-UWB radar sensor to detect the indoor presence of the user.

The indoor presence detection unit 123 may transmit an analog signal to first, second, and third areas in the house of the user at a predetermined period using a sensor, and receive the transmitted signal, in which the indoor presence detection unit 123 may detect the indoor presence of the user based on the change in output when receiving the signal transmitted to each area.

The first area, the second area, and the third area may correspond to at least one of a living room, a room, a bathroom, and a kitchen in the house of the user.

The indoor presence detection unit 123 may transmit an analog signal having a first voltage to the first area, the second area, and the third area at a preset period using a sensor and receive the transmitted signal, in which, when an analog signal having a second voltage or higher is received for a time longer than a preset time, it may be detected as a human body activity so that the indoor presence of the user is detected. For example, the indoor presence detection unit 123 may transmit an analog signal having 4 V to 6 V to the first area, the second area, and the third area using a sensor at a predetermined period and receive the transmitted signal, in which if an analog signal having 2 V to 3 V or more is received for 2 to 4 seconds or more, it may be detected as a human body activity so that the indoor presence of the user is detected. The outside activity time calculation unit 130 determines the door open, and when no human body activity is detected for a preset time from the time point at which the door open is recognized, it is determined as an outside activity state, and the time for maintaining the outside activity state is calculated.

The outside activity time calculation unit 130 determines the outside activity state if no human body activity is detected for a preset period of time by the indoor presence detection unit 123 from the time point at which the door open of any one of the entrance door, the room door, and the toilet door is recognized.

For example, the outside activity time calculation unit 130 may recognize the door open of the entrance door, transmit the analog signal to the first area, the second area, and the third area at a preset period, and receive the transmitted signal using the sensor from the time point at which the door open is recognized, in which if there is no change in the output and no inside human activity is detected for a preset period of time, it may be determined as the outside activity state.

In addition, the outside activity time calculation unit 130 may be configured to calculate the outside activity duration starting from a time point at which the door open is recognized and the human body activity is not detected by the indoor presence detection unit 123 till a time point at which the door open is re-recognized and the human body activity is detected by the indoor presence detection unit 123.

For example, when the door open is recognized at '14:00' and no human body activity is detected from '14:00', and when the door open is recognized at '17:38', and the human body activity is detected by the indoor presence detection unit 123 from '17:38', the outside activity time calculation unit 130 may calculate the outside activity duration as '3 hours and 38 minutes', which is the time from '14:00' to '17:38'.

The inside activity time calculation unit 140 may determine an inside activity state when the human body activity is detected at a first time point and the human body activity is detected again at a second time point having an idle detection period after the first time point, and calculates an inside activity duration which is a time during which the inside activity state is maintained.

The inside activity time calculation unit 140 may determine the inside activity state when the human body activity is detected in the first to third areas at a first time point, a predetermined idle detection period is set after the first time point, and the human body activity is detected again at a second time point after the idle detection period. For example, when the indoor presence detection unit 123 transmits an analog signal to the first area, the second area, and the third area at a preset period using a sensor and receives the transmitted signal, the inside activity time calculation unit 140 may detect as the human body activity if the signal has an output of a predetermined level or above, and when the transmitted analog signal is received again at the second time point with a preset idle detection period (for example, 30 minutes) after the first time point at which the human body activity is detected, if the signal has an output of a predetermined level or above, it is determined as an inside activity state.

In addition, the inside activity time calculation unit 140 calculates the inside activity duration when the human body activity is detected at the first time point and the idle detection period is set after the first time point, starting from the first time point till the second time point in which the human body activity is detected again after the idle detection period.

For example, when the human body activity is detected at '10:00', the idle detection period is set to '30 minutes' after '10:00', and the human body activity is detected again at '12:00', and the human body activity is detected by the indoor presence detection unit 123 from '17:38', the inside activity time calculation unit 140 may calculate the inside activity duration as '2 hours'.

Detecting the human body activity may mean that the human body activity is detected when an output of a signal is equal to or higher than a preset level in the process of transmitting an analog signal and receiving the transmitted signal at a preset period using a sensor.

For example, an analog signal of 4 V to 6 V is continuously transmitted and the transmitted signal is received at a preset period by using a sensor and if the analog signal of 2 V to 3 V is received for 2 seconds to 4 seconds or more, it is determined that the human body activity is detected.

The activity type categorization unit 150 calculates the inside activity duration and the outside activity duration accumulated for a preset period, then calculates the relative ratio of the inside activity duration and the outside activity duration, and classifies human body activity types based on whether the outside activity duration or the inside activity duration exceeds a preset threshold and based on the relative ratio.

The activity type categorization unit 150 may classify the activity type as a first activity type when the outside activity duration is equal to or greater than a first threshold value, and a ratio of the outside activity duration to the inside activity duration is equal to or greater than a first ratio value.

The activity type categorization unit 150 may classify the activity type as a second activity type when the outside activity duration is greater than or equal to a preset first threshold, and a first ratio value of the outside activity duration to the inside activity duration is less than a preset ratio.

The activity type categorization unit 150 may classify the activity type as a third activity type when the outside activity duration is less than a preset first threshold, and a first ratio value of the outside activity duration to the inside activity duration is greater than or equal to a preset ratio.

The activity type categorization unit 150 may classify the activity type as a fourth activity type when the outside activity duration is less than a preset first threshold, and a first ratio value of the outside activity duration to the inside activity duration is less than the preset ratio.

TABLE 1

| Activity type | Absolute assessment | Relative assessment |
|---|---|---|
| $1^{st}$ activity type | 5 hours or more of outside activity duration | Difference in ratio of outside activity duration to inside activity duration is 30% or more |
| $2^{nd}$ activity type | 5 hours or more of outside activity duration | Difference in ratio of outside activity duration to inside activity duration is less than 30% |
| $3^{rd}$ activity type | Less than 5 hours of outside activity duration | Difference in ratio of outside activity duration to inside activity duration is 30% or more |
| $4^{th}$ activity type | Less than 5 hours of outside activity duration | Difference in ratio of outside activity duration to inside activity duration is less than 30% |

Table 1 shows an example in which the activity type categorization unit 150 classifies the activity type into the first activity type to the fourth activity type through the absolute assessment and the relative assessment.

Referring to Table 1 and FIG. 2, when the preset threshold is '5 hours' and the preset ratio is '30%', the inside activity duration of a first user is '17 hours' and the outside activity duration of the first user is '7 hours', so the outside activity duration of the first user is '5 hours' or more and the ratio of the outside activity duration to the inside activity duration is '30%' or more (41%), so that the activity type categorization unit 150 may classify the first user as the first activity type.

In addition, since the inside activity duration of a second user is '19 hours' and the outside activity duration of the second user is '5 hours', the outside activity duration of the second user is '5 hours' or more and the ratio of the outside activity duration to the inside activity duration is less than '30%' (26%), so the activity type categorization unit 150 may classify the second user as the second activity type.

Meanwhile, since the inside activity duration of a third user is '13 hours' and the outside activity duration of the third user is '4 hours', the outside activity duration of the third user is less than '5 hours' and the ratio of the outside activity duration to the inside activity duration is '30%' or more (30.7%), so the activity type categorization unit 150 may classify the third user as the third activity type.

In addition, since the inside activity duration of a fourth user is '15 hours' and the outside activity duration of the fourth user is '3 hours', the outside activity duration of the fourth user is less than '5 hours' and ratio of the outside activity duration to the inside activity duration is less than '30%' (20%), so the activity type categorization unit 150 may classify the fourth user as the fourth activity type.

According to the present invention, the user is classified as the first activity type to the fourth activity type (for example, outside activity type, balanced activity type, inside activity type, and passive activity type) by the activity type categorization unit 150, so that it is possible to efficiently predict the possibility of lonely death by observing signs that are inconsistent with the activity types of each user.

The risk assessment unit 160 generates a probability distribution model based on the outside activity duration and the inside activity duration calculated in the first period, and assesses the risk of lonely death by applying the outside activity duration and inside activity duration calculated after the first period to the probability distribution model.

The risk assessment unit 160 calculates an average value of the inside activity duration and outside activity duration of the users in the first period, and generates the probability distribution model.

The probability distribution model may be a normal distribution, and the risk assessment unit 160 may generate the probability distribution model having a perfectly homogeneous symmetric distribution based on the average value of the inside activity duration and outside activity duration of the users in the first period.

In addition, the risk assessment unit 160 calculates the inside activity duration and the outside activity duration after the first period by applying different weights to the inside activity duration and the outside activity duration of the first period according to the first activity type to the fourth activity type of the users.

The risk assessment unit 160 may assess the risk of the lonely death by comparing the outside activity duration and the inside activity duration, which are calculated after the first period by applying weights that are set differently according to the activity types of users, with the probability distribution model generated based on the average values of the outside activity duration and the inside activity duration calculated in the first period.

The risk assessment unit 160 may apply different weights according to the activity type of the user in order to assess the risk as a first risk when the inside activity duration and the outside activity duration calculated after the first period are within a first threshold of each average value of the inside activity duration and the outside activity duration calculated in the first period, as a second risk when it exceeds the first threshold and belongs to a second threshold, as a third risk when it exceeds the second threshold and belongs to a third threshold, and as a fourth risk when it exceeds the third threshold.

For example, the risk assessment unit 160 may determine the first risk when the outside activity duration or inside activity duration to which the first weight to the fourth weight are applied according to the first to fourth activity types for a preset period is within '30% of the average, may determine the second risk when it exceeds '30%' and falls within '60%', may determine the third risk when it exceeds '60%' and falls within '80%', and may determine the fourth risk when it exceeds '80%'.

Further, referring to FIGS. 2 to 3, the average of the inside activity duration of the first to fourth users is '16 hours' and the average of the outside activity duration is '4.75 hours'.

Hereinafter, the description will be made based on the assumption that the risk assessment unit 160 sets the weight for the outside activity duration of the first activity type as '0.8', the weight for the inside activity duration of the first activity type as '0.6', the weight for the outside activity duration of the second activity type as '0.8', the weight for the inside activity duration of the second activity type as '0.8', the weight for the outside activity duration of the third activity type as '0.6', the weight for the inside activity duration of the third activity type as '1', the weight for the outside activity duration of the fourth activity type as '1', and the weight for the inside activity duration of the fourth activity type as '1'.

Based on the classification of each user type by the activity type categorization unit 150, referring to the first user, since the first user has the first activity type, the inside activity duration weighted according to the first activity type is '13.6 hours', so it falls within '30%' (15%) of '16 hours', which is the average of the inside activity duration of the first to fourth users. Thus, the risk assessment unit 160 may determine the risk, which is based on the inside activity duration of the first user, as the first risk. In addition, since the outside activity duration of the first user weighted according to the first activity type is '4.2 hours', it falls within '30%' (11.58%) of '4.75 hours', which is the average of the outside activity duration of the first to fourth users. Thus, the risk assessment unit 160 may determine the risk, which is based on the outside activity duration of the first user, as the first risk.

In addition, referring to the third user, since the third user has the third activity type, the inside activity duration weighted according to the third activity type is '7.8 hours', so it exceeds '30%' of '16 hours', which is the average of the inside activity duration of the first to fourth users, and falls within '60%' (51.25%). Thus, the risk assessment unit 160 may determine the risk, which is based on the inside activity duration of the third user, as the second risk. In addition, since the outside activity duration of the third user weighted according to the third activity type is '4 hours', it falls within '30%' (15.79%) of '4.75 hours', which is the average of the outside activity duration of the first to fourth users. Thus, the risk assessment unit 160 may determine the risk, which is based on the outside activity duration of the third user, as the first risk.

According to the present invention, the first to fourth risks for each user are assessed in terms of safety, caution, alertness, and danger, so that there is an effect that the user can be more carefully managed according to the level of risk.

FIG. 5 is a flowchart illustrating a method for assessing the risk of lonely death using a door open sensor according to another embodiment of the present invention. The method for assessing the risk of lonely death using the door open sensor according to another embodiment of the present invention can be performed by the device for assessing the risk of lonely death using the door open sensor according to one embodiment of the present invention and the LED system for assessing the risk of lonely death using the door open sensor according to another embodiment of the present invention. Hereinafter, a method for assessing the risk of lonely death using a door open sensor according to another embodiment of the present invention will be described with reference to FIG. 5, and the redundant contents and configurations that have been described with reference to FIGS. 1 to 4 in the device for assessing the risk of lonely death using the door open sensor according to one embodiment of the present invention and the LED system for assessing the risk of lonely death using the door open sensor according to another embodiment of the present invention will be denoted with the same reference numerals and repeated descriptions thereof will be omitted.

First, the door open recognition unit 110 recognizes the door open (S110).

The door open recognition unit 110 may recognize the door open of each door through a sensor attached to an entrance door, a room door, and a toilet door in a house of a user whenever the door is opened.

The indoor presence detection unit 123 transmits a signal having a predetermined pattern to a predetermined area and receives the transmitted signal, and includes a sensor having an output of a predetermined level or higher when a human body activity is detected in the predetermined area detect to detect whether the user is present in the room (S120).

The indoor presence detection unit 123 may be equipped with an IR-UWB radar sensor to detect the presence of the user.

The indoor presence detection unit 123 may transmit an analog signal to first, second, and third areas in the house of the user at a predetermined period using a sensor, and receive the transmitted signal, in which the indoor presence detection unit 123 may detect the indoor presence of the user based on the change in output when receiving the signal transmitted to each area.

The first area, the second area, and the third area may correspond to at least one of a living room, a room, a bathroom, and a kitchen in the house of the user.

The indoor presence detection unit 123 may transmit an analog signal having a first voltage to the first area, the second area, and the third area at a preset period using a sensor and receive the transmitted signal, in which, when an analog signal having a second voltage or higher is received for a time longer than a preset time, it may be detected as a human body activity so that the indoor presence of the user is detected. For example, the indoor presence detection unit 123 may transmit an analog signal having 4 V to 6 V to the first area, the second area, and the third area using a sensor at a predetermined period and receive the transmitted signal, in which if an analog signal having 2 V to 3 V or more is received for 2 to 4 seconds or more, it may be detected as a human body activity so that the indoor presence of the user is detected. The outside activity time calculation unit 130 determines the door open, and when no human body activity is detected for a preset time from the time point at which the door open is recognized, it is determined as an outside activity state, and the time for maintaining the outside activity state is calculated (S130).

The outside activity time calculation unit 130 determines the outside activity state if no human body activity is detected for a preset period of time by the indoor presence detection unit 123 from the time point at which the door open of any one of the entrance door, the room door, and the toilet door is recognized.

For example, the outside activity time calculation unit 130 may recognize the door open of the entrance door, transmit the analog signal to the first area, the second area, and the third area at a preset period, and receive the transmitted signal using an IR-UWB radar sensor from the time point at which the door open is recognized, in which if there is no change in the output and no inside human activity is detected for a preset period of time, it may be determined as the outside activity state.

In addition, the outside activity time calculation unit 130 may be configured to calculate the outside activity duration starting from a time point at which the door open is recognized and the human body activity is not detected by the indoor presence detection unit 123 till a time point at which the door open is re-recognized and the human body activity is detected by the indoor presence detection unit 123.

For example, when the door open is recognized at '14:00' and no human body activity is detected from '14:00', and when the door open is recognized at '17:38', and the human body activity is detected by the indoor presence detection unit 123 from '17:38', the outside activity time calculation unit 130 may calculate the outside activity duration as '3 hours and 38 minutes', which is the time from '14:00' to '17:38'.

The inside activity time calculation unit 140 may determine an inside activity state when the human body activity is detected at a first time point and the human body activity is detected again at a second time point having an idle detection period after the first time point, and calculates an inside activity duration which is a time during which the inside activity state is maintained (S140).

The inside activity time calculation unit 140 may determine the inside activity state when the human body activity is detected in the first to third areas at a first time point, a predetermined idle detection period is set after the first time point, and the human body activity is detected again at a second time point after the idle detection period.

The activity type categorization unit 150 calculates the inside activity duration and the outside activity duration accumulated for a preset period, then calculates the relative ratio of the inside activity duration and the outside activity duration, and classifies human body activity types based on whether the outside activity duration or the inside activity duration exceeds a preset threshold and based on the relative ratio (S150).

The activity type categorization unit 150 may classify the activity type as a first activity type when the outside activity duration is equal to or greater than a first threshold value, and a ratio of the outside activity duration to the inside activity duration is equal to or greater than a first ratio value.

The activity type categorization unit 150 may classify the activity type as a second activity type when the outside activity duration is greater than or equal to a preset first threshold, and a first ratio value of the outside activity duration to the inside activity duration is less than a preset ratio.

The activity type categorization unit 150 may classify the activity type as a third activity type when the outside activity duration is less than a preset first threshold, and a first ratio value of the outside activity duration to the inside activity duration is greater than or equal to a preset ratio.

The activity type categorization unit 150 may classify the activity type as a fourth activity type when the outside activity duration is less than a preset first threshold, and a first ratio value of the outside activity duration to the inside activity duration is less than the preset ratio.

The risk assessment unit 160 generates a probability distribution model based on the outside activity duration and the inside activity duration calculated in the first period, and assesses the risk of lonely death by applying the outside activity duration and inside activity duration calculated after the first period to the probability distribution model (S160).

The risk assessment unit 160 calculates an average value of the inside activity duration and outside activity duration of the users in the first period, and generates the probability distribution model.

The probability distribution model may be a normal distribution, and the risk assessment unit 160 may generate the probability distribution model having a perfectly homogeneous symmetric distribution based on the average value of the inside activity duration and outside activity duration of the users in the first period.

In addition, the risk assessment unit 160 calculates the inside activity duration and the outside activity duration after the first period by applying different weights to the inside activity duration and the outside activity duration of the first period according to the first activity type to the fourth activity type of the users.

The risk assessment unit 160 may assess the risk of the lonely death by comparing the outside activity duration and the inside activity duration, which are calculated after the first period by applying weights that are set differently according to the activity types of users, with the average values of the inside activity duration and the outside activity duration calculated in the first period.

The risk assessment unit 160 may apply different weights according to the activity type of the user in order to assess the risk as a first risk when the inside activity duration and the outside activity duration calculated after the first period are within a first threshold of each average value of the inside activity duration and the outside activity duration calculated in the first period, as a second risk when it exceeds the first threshold and belongs to a second threshold, as a third risk when it exceeds the second threshold and belongs to a third threshold, and as a fourth risk when it exceeds the third threshold.

For example, the risk assessment unit 160 may determine the first risk when the outside activity duration or inside activity duration to which the weight is applied according to the activity types for a preset period is within '30% of the average, may determine the second risk when it exceeds '30%' and falls within '60%', may determine the third risk when it exceeds '60%' and falls within '80%', and may determine the fourth risk when it exceeds '80%'.

Further, referring to FIGS. 2 to 3, the average of the inside activity duration of the first to fourth users is '16 hours' and the average of the outside activity duration is '4.75 hours'.

Hereinafter, the description will be made based on the assumption that the risk assessment unit 160 sets the weight for the outside activity duration of the first activity type as '0.8', the weight for the inside activity duration of the first activity type as '0.6', the weight for the outside activity duration of the second activity type as '0.8', the weight for the inside activity duration of the second activity type as '0.8', the weight for the outside activity duration of the third activity type as '0.6', the weight for the inside activity duration of the third activity type as '1', the weight for the outside activity duration of the fourth activity type as '1', and the weight for the inside activity duration of the fourth activity type as '1'.

Based on the classification of each user type by the activity type categorization unit 150, referring to the first user, since the first user has the first activity type, the inside activity duration weighted according to the first activity type is '13.6 hours', so it falls within '30%' (15%) of '16 hours', which is the average of the inside activity duration of the first to fourth users. Thus, the risk assessment unit 160 may determine the risk, which is based on the inside activity duration of the first user, as the first risk. In addition, since the outside activity duration of the first user weighted according to the first activity type is '4.2 hours', it falls within '30%' (11.58%) of '4.75 hours', which is the average of the outside activity duration of the first to fourth users. Thus, the risk assessment unit 160 may determine the risk, which is based on the outside activity duration of the first user, as the first risk.

In addition, referring to the third user, since the third user has the third activity type, the inside activity duration weighted according to the third activity type is '7.8 hours', so it exceeds '30%' of'16 hours', which is the average of the inside activity duration of the first to fourth users, and falls within '60%' (51.25%). Thus, the risk assessment unit 160 may determine the risk, which is based on the inside activity duration of the third user, as the second risk. In addition, since the outside activity duration of the third user weighted according to the third activity type is '4 hours', it falls within '30%' (15.79%) of '4.75 hours', which is the average of the outside activity duration of the first to fourth users. Thus, the risk assessment unit 160 may determine the risk, which is based on the outside activity duration of the third user, as the first risk.

According to the present invention, the first to fourth risks for each user are assessed in terms of safety, caution, alertness, and danger, so that there is an effect that the user can be more carefully managed according to the level of risk.

Although the present invention has been described above in detail with reference to preferred embodiments, the present invention is not limited thereto and may be implemented in various ways within the scope of the claims. In particular, since the foregoing has rather broadly described the features and technical advantages of the present invention in order to better understand the claims of the present invention to be described later, it should be recognized by those skilled in the art that the concept and specific embodiments of the present invention described above can be used immediately as a basis for designing or modifying other shapes in order to carry out purposes similar to the purpose of the present invention.

In addition, the embodiment described above is only one embodiment according to the present invention, and it can be understood that the embodiment can be variously modified and changed within the scope of the technical spirit of the present invention by those skilled in the art. Accordingly, the disclosed embodiments should be considered in an illustrative view point rather than a restrictive viewpoint, and such various modifications and changes also belong to the scope of the technical spirit of the present invention defined in the claims of the present invention to be described later, and all differences within the equivalent range of the claims should be construed as being included in the present invention.

The invention claimed is:

1. A device for assessing a risk of lonely death using a door open sensor, the device comprising:

a door open recognition unit which recognizes a door open;

an outside activity time calculation unit which determines as an outside activity state when a human body activity is not detected for a predetermined time from a time point at which the door open is recognized, and calculates an outside activity duration which is a time during which the outside activity state is maintained;

an inside activity time calculation unit which determines as an inside activity state when the human body activity is detected at a first time point and the human body activity is detected again at a second time point having an idle detection period after the first time point, and calculates an inside activity duration which is a time during which the inside activity state is maintained;

a risk assessment unit which assesses the risk of lonely death by generating a probability distribution model based on the outside activity duration and inside activity duration calculated in a first period, and applying the outside activity duration and inside activity duration calculated after the first period to the probability distribution model; and an activity type categorization unit that calculates a relative ratio of the inside activity duration and the outside activity duration, and classifies human body activity types based on whether the outside activity duration or the inside activity duration exceeds a preset threshold and based on the relative ratio, wherein the activity type categorization unit is configured, to determine as an outside activity type which is a first activity type when the outside activity duration is equal to or greater than a preset first threshold, and a ratio of the outside activity duration to the inside activity duration is equal to or greater than a first ratio value, to determine as a balanced activity type which is a second activity type when the outside activity duration is equal to or greater than the first threshold, and a ratio of the outside activity duration to the inside activity duration is less than the first ratio value, to determine as an inside activity type which is a third activity type when the outside activity duration is less than the first threshold, and a ratio of the outside activity duration to the inside activity duration is equal to or greater than the first ratio value, and to determine as a passive activity type which is a fourth activity type when the outside activity duration is less than the first threshold, and a ratio of the outside activity duration to the inside activity duration is less than the first ratio value, and wherein the risk assessment unit is configured to assess the risk of the lonely death by applying weights, which are set differently for each of the first to fourth activity types, to the outside activity duration and the inside activity duration calculated after the first period and by comparing the outside activity duration and the inside activity duration with average values of the outside activity duration and the inside activity duration calculated in the first period, respectively.

2. The device of claim 1, further comprising an indoor presence detection unit configured to transmit a signal having a predetermined pattern to a predetermined area and receive the transmitted signal, wherein the indoor presence detection unit includes a sensor having an output equal to or higher than a preset level to detect indoor presence when a human body activity is detected in the predetermined area.

3. The device of claim 2, wherein the outside activity time calculation unit is configured to calculate the outside activity duration starting from a time point at which the door open is recognized and the human body activity is not detected by the indoor presence detection unit till a time point at which the door open is re-recognized and the human body activity is detected by the indoor presence detection unit.

4. The device of claim 2, wherein the inside activity time calculation unit is configured to calculate the inside activity duration when the human body activity is detected at the first time point and the idle detection period is set after the first time point, starting from the first time point till the second time point in which the human body activity is detected again after the idle detection period.

5. A method for assessing a risk of lonely death using a door open sensor, the method comprising:

recognizing a door open;

determining as an outside activity state when a human body activity is not detected for a predetermined time from a time point at which the door open is recognized, and calculating an outside activity duration which is a time during which the outside activity state is maintained;

determining as an inside activity state when the human body activity is detected at a first time point and the human body activity is detected again at a second time point having an idle detection period after the first time point, and calculating an inside activity duration which is a time during which the inside activity state is maintained;

calculating a relative ratio of the inside activity duration and the outside activity duration, and classifying human body activity types based on whether the outside activity duration or the inside activity duration exceeds a preset threshold and based on the relative ratio; and assessing the risk of the lonely death by generating a probability distribution model based on the outside activity duration and inside activity duration calculated in a first period, and applying the outside activity duration and inside activity duration calculated after the first period to the probability distribution model, wherein the classifying step is configured, to determine as an outside activity type which is a first activity type when the outside activity duration is equal to or greater than a preset first threshold, and a ratio of the outside activity duration to the inside activity duration is equal to or greater than a first ratio value, to determine as a balanced activity type which is a second activity type when the outside activity duration is equal to or greater than the first threshold, and a ratio of the outside activity duration to the inside activity duration is less than the first ratio value, to determine as an inside activity type which is a third activity type when the outside activity duration is less than the first threshold, and a ratio of the outside activity duration to the inside activity duration is equal to or greater than the first ratio value, and to determine as a passive activity type which is a fourth activity type when the outside activity duration is less than the first threshold, and a ratio of the outside activity duration to the inside activity duration is less than the first ratio value, and wherein the assessing step is configured to assess the risk of the lonely death by applying weights, which are set differently for each of the first to fourth activity types, to the outside activity duration and the inside activity duration calculated after the first period and by comparing the outside activity duration and the inside activity duration with average values of the outside activity duration and the inside activity duration calculated in the first period, respectively.

6. The method of claim 5, further comprising detecting an indoor presence between the recognizing step and calculating step for the outside activity duration, wherein, in the detecting step, a signal having a predetermined pattern is transmitted to a predetermined area and the transmitted signal is received, and the indoor presence is detected by using a sensor having an output equal to or higher than a preset level when a human body activity is detected in the predetermined area.

7. The method of claim 6, wherein the calculating of the outside activity duration is to calculate the outside activity duration starting from a time point at which the door open is recognized and the human body activity is not detected by the indoor presence detection unit till a time point at which the door open is re-recognized and the human body activity is detected by the indoor presence detection unit.

8. The method of claim 6, wherein the calculating of the inside activity duration is to calculate the inside activity duration when the human body activity is detected at the first time point and the idle detection period is set after the first time point, starting from the first time point till the second time point, in which the human body activity is detected again after the idle detection period.

9. An LED system for assessing a risk of lonely death, the LED system comprising:

an LED module including a light emitting device for allowing an LED on an LED substrate to emit light so that the light is diffused, and an indoor presence detection unit configured to transmit a signal having a predetermined pattern to a predetermined area and receive the transmitted signal, in which the indoor presence detection unit includes a sensor having an output equal to or higher than a preset level to detect indoor presence when a human body activity is detected in the predetermined area;

a door open recognition unit which recognizes a door open;

an outside activity time calculation unit which determines as an outside activity state when a human body activity is not detected for a predetermined time from a time point at which the door open is recognized, and calculates an outside activity duration which is a time during which the outside activity state is maintained;

an inside activity time calculation unit which determines as an inside activity state when the human body activity is detected at a first time point and the human body activity is detected again at a second time point having an idle detection period after the first time point, and calculates an inside activity duration which is a time during which the inside activity state is maintained;

a risk assessment unit which assesses the risk of lonely death by generating a probability distribution model based on the outside activity duration and inside activity duration calculated in a first period, and applying the outside activity duration and inside activity duration calculated after the first period to the probability distribution model; and an activity type categorization unit that calculates a relative ratio of the inside activity duration and the outside activity duration, and classifies human body activity types based on whether the outside activity duration or the inside activity duration exceeds a preset threshold and based on the relative ratio, wherein the activity type categorization unit is configured, to determine as an outside activity type which is a first activity type when the outside activity duration is equal to or greater than a preset first threshold, and a ratio of the outside activity duration to the inside activity duration is equal to or greater than a first ratio value, to determine as a balanced activity type which is a second activity type when the outside activity duration is equal to or greater than the first threshold, and a ratio of the outside activity duration to the inside activity duration is less than the first ratio value, to determine as an inside activity type which is a third activity type when the outside activity duration is less than the first threshold, and a ratio of the outside activity duration to the inside activity duration is equal to or greater than the first ratio value, and to determine as a passive activity type which is a fourth activity type when the outside activity duration is less than the first threshold, and a ratio of the outside activity duration to the inside activity duration is less than the first ratio value, and wherein the risk assessment unit is configured to assess the risk of the lonely death by applying weights, which are set differently for each of the first to fourth activity types, to the outside activity duration and the inside activity duration calculated after the first period and by comparing the outside activity duration and the inside activity duration with average values of the outside activity duration and the inside activity duration calculated in the first period, respectively.

* * * * *